United States Patent [19]

Witte

[11] 4,112,836

[45] Sep. 12, 1978

[54] APPARATUS FOR TREATING OIL CONTAINING VEGETABLE RAW MATERIALS

[75] Inventor: Johan Frederik Witte, Amsterdam-Nieuwendam, Netherlands

[73] Assignee: Stork Amsterdam B.V., Sportlaan, Amstelveen, Netherlands

[21] Appl. No.: 646,867

[22] Filed: Jan. 5, 1976

Related U.S. Application Data

[63] Continuation of Ser. No. 443,844, Feb. 19, 1974, abandoned.

[30] Foreign Application Priority Data

Feb. 20, 1973 [NL] Netherlands ..... 7302358

[51] Int. Cl.[2] ..... A27C 3/02

[52] U.S. Cl. ..... 99/483; 99/495

[58] Field of Search ..... 99/483, 495, 576; 426/312, 314, 506–511, 519–521, 431; 209/468; 34/DIG. 2

[56] References Cited

U.S. PATENT DOCUMENTS

| | | | |
|---|---|---|---|
| 217,053 | 7/1879 | Brooke | 99/516 |
| 2,708,627 | 5/1955 | Toulmin | 426/489 |
| 3,173,768 | 3/1965 | Witte | 209/468 |
| 3,216,344 | 11/1965 | Beagle | 99/477 |
| 3,220,451 | 11/1965 | Bollens | 426/489 |
| 3,457,851 | 7/1969 | Hibbard | 426/521 |
| 3,548,737 | 12/1970 | Evans | 99/235 |

*Primary Examiner*—Harvey C. Hornsby
*Assistant Examiner*—Arthur O. Henderson
*Attorney, Agent, or Firm*—Haseltine, Lake & Waters

[57] ABSTRACT

Apparatus for treating oil-containing vegetable raw materials by the influence of moisture and heat, whereby during the exposure of a rather thin layer of the oil-containing raw materials to a moisture and heat transfer fluid, the raw materials are subjected to a loosening movement, preferably by means of a vibration.

3 Claims, 2 Drawing Figures

APPARATUS FOR TREATING OIL CONTAINING VEGETABLE RAW MATERIALS

CROSS-RELATED APPLICATION

This application is a continuation of co-pending application Ser. No. 443,844 filed Feb. 19, 1974 (now abandoned) and claiming the priority of the application filed in the Netherlands on Feb. 20, 1973.

FIELD OF THE INVENTION

The invention relates to apparatus for the pre-treatment of oil-containing vegetable raw materials, by extracting the oil, effected by the influence of moisture and heat, if desired, with subsequent removal of excess moisture.

BACKGROUND

A process is already known according to which oil containing seeds are heated in so-called cookers or flour boilers in the presence of moisture. Such a flour boiler is constituted as a vessel with a plurality of hollow plates disposed one over the other, each provided with a passage whose discharge opening is located over a plate situated thereunder. The oil-containing seeds are essentially indirectly heated by the plates.

In order to extract oil from oil-containing vegetable raw materials, such as fruits or seeds, by squeezing or extracting by means of solvents, it is necessary to expose these raw materials previously to number of pre-treatments. Irrespective of the specific pre-treatments for each kind of seed and the differences due to extracting or crushing, the folowing examples of pre-treaments can be mentioned in arbitrary order of succession, i.e.: removal of shells, skins or husks, pulverizing, rolling, heating, drying and cooling.

In dependence of the raw material and the oil extraction process proper, one or more of these pre-treatments are required and some of them even simultaneously. Although the mechanisms between pre-treatment and oil extraction are not yet entirely known, the pre-treatments effectuate that:

cell material is opened, whereby the oil is more easily released;

undesired components, such as albumins, slime and the like are fixed and become insoluble;

the rest of the cell walls are strengthened.

The known process suffers, however, from the disadvantage that the residence of the product in the cookers or flour boilers often exceeds the optimally necessary time, while moreover a uniform well controlled threatment of the particles is impossible. This is caused by the very poor heat conduction and heat transfer, due to the fact that in the known process the heat supply is substantially indirect, that is to say it is effected via a heat exchanging surface, while additionally, the heat conductivity of the product to be treated is very in-sufficient, since it is in the form of bulk material when exposed to the treatments.

SUMMARY OF THE INVENTION

It has been found that vegetable oil-containing raw materials can also be efficiently treated in shorter treatment times than required in the known methods. Apart therefrom, the conditions under which the process is carried out are excellent, so that the raw materials are brought into an optimal condition for the further treatment of the oil therein.

This is attained by exposing the oil-containing vegetable raw materials to a moisture and/or heat transfer fluid, by which at least a continuous or discontinuous condition is effected in which the particles are loosened from each other, the moisture and/or heat transfer fluid being caused to act directly upon the vegetable raw materials when the particles are in the said loosened condition.

There is thus obtained an excellent heat and moisture transfer, which is attended with a considerable reduction of the required treatment times and a more uniformly controlled treatment of the vegetable raw material particles.

The vegetable raw materials in the shape of a rather thin layer are preferably subjected to a directed vibration and conveying treatment, during which treatment a moisture and/or heat transfer gaseous fluid is caused to act on the vegetable raw materials.

Consequently, a very remarkable improvement is obtained which is associated with the fact that the particles contact each other regularly for a short time, due to mutual collision and that they are separated from each other for a short time, while the heat and moisture transfer fluid can easily act upon each individual particle.

During the removal of excess moisture, it is also advisable to have the particles contact each other regularly for a short time and to keep them apart for a short time.

The action of moisture and heat on the raw materials is effected by bringing the vegetable raw materials into direct contact with fluids for the heat and moisture transfer. In order to obtain the desired conditions of the raw materials, one may arbitrarily use conditioned air with a temperature ranging from 15° to 150° C., steam, cold water and the like. Due to the fact that these heat and moisture transfer fluids directly contact the raw materials, local superheating or even lump formation owing to local moisture accumulations, are avoided. Insofar as in the foregoing a rather thin layer is described, this is understood to be a layer of some centimetres in thickness and preferably ranging from 1 to 10 cm in thickness.

BRIEF DESCRIPTION OF THE DRAWING

The process in question can be performed in a suitable manner in a device of the type as described hereinafter with reference to the drawing.

DETAILED DESCRIPTION

Figure 1:
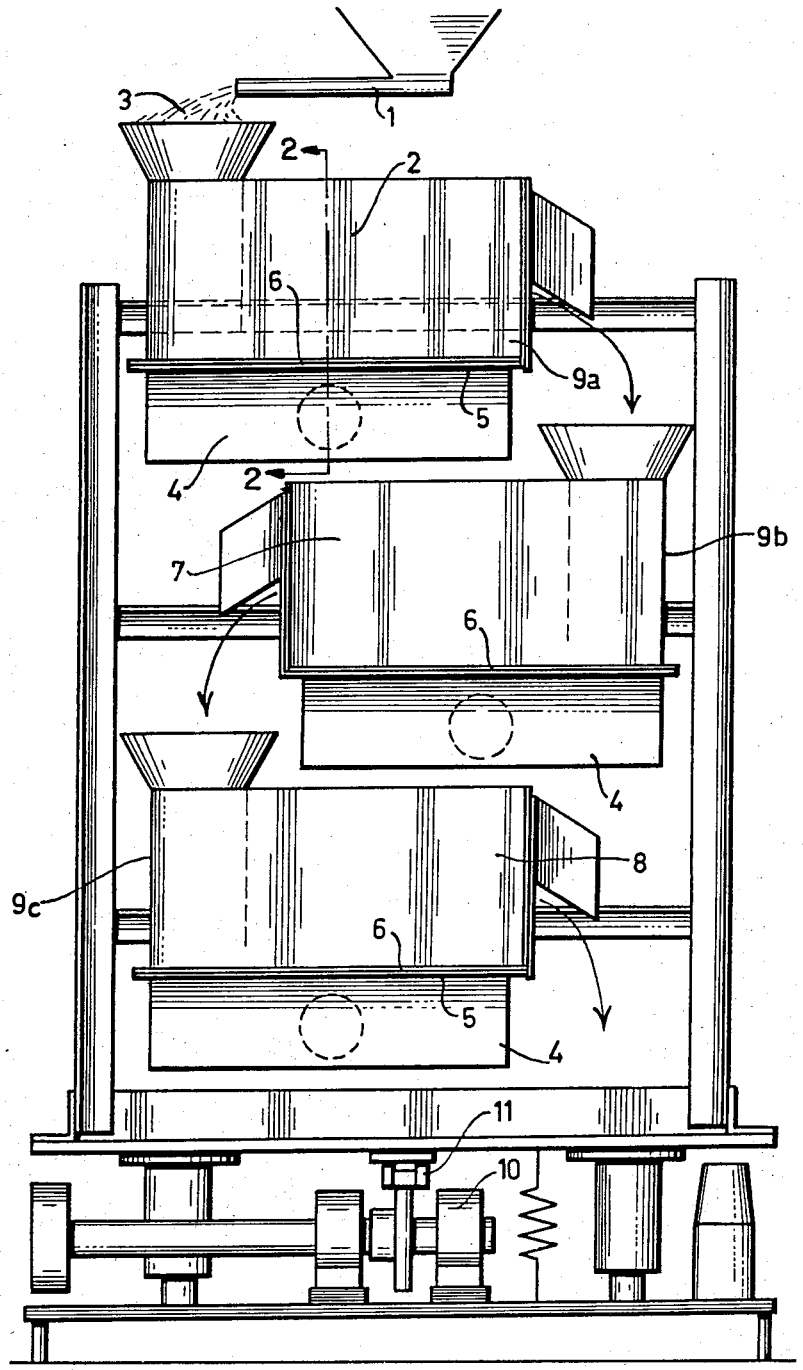
FIG. 1 is a diagrammatic elevational view of apparatus according to the invention.
Figure 2:
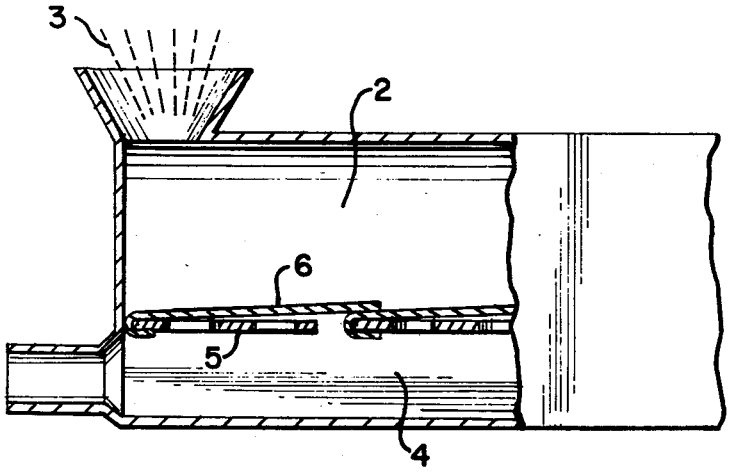
FIG. 2 is a partial section taken along line 2—2 in FIG. 1.

The material 3 to be treated, e.g. beans, seeds or fruits, whether previously broken, shelled and rolled or not, is fed to a feeding and metering system 1 of the device. The discharged material then has by preceding treatments, if any, a particular temperature value and moisture content. In a first part 2 of the continuously operating device, the raw materials 3 are simultaneously moistened and heated by means of steam through pipe 4. For this purpose, this part is divided into various sections 5 to which through perforated bottoms 6, both steam and heated air are supplied. The transport in the device is performed by a combination of the overflow principle and a vibration of a vibrating gutter 9*a*, while the heat and moisture transfer is effected in a more or less fluidized condition. As a result, the time during which the raw materials stay in this part is considerably reduced, in order to attain the process conditions which are desired for the second stage of the treatment. Usually the raw materials do not stay longer than 5 minutes in this part, contrary to the time required in the conventional cookers, for this part of the treatment, which is in the range of 5 to 20 minutes. At a second stage 7 of the treatment, a maximum temperature of the raw materials is maintained for some time at a value ranging from 95° to 115° C. Due to a proper control of the process, that is to say a uniform regulation of the temperature, one avoids at this stage, too, that the stay of the materials in this part of the device, exceeds optimal values. After the second stage of the treatment, the raw materials are introduced into the third part 8. In this part, the moisture content and the temperature of the raw materials are again reduced to values required for the extraction or crushing. In this case, too, a combination of the overflow principle and vibration is used, whereby the particles are temporarily kept apart, while the transfer of heat and moisture is effected in a more or less fluidized state by means of conditioned air.

According to the invention, it is now possible to work with:

(a) very short and uniform residence times between 2 and 10 minutes contrary to the conventional residence times of between 20 and 45 minutes, while in order to attain the desired conditions of the raw materials, arbitrarily conditioned air with a temperature between 15° and 150° C., steam or cold water can be used;

(b) direct contact between the heat and moisture transfer fluid and the raw materials, whereby local superheating or lump formation by local moisture accumulations are avoided.

Preferably, the device comprises one or more vibratory conveyors 9*a*, 9*b* and 9*c* disposed in a cascade configuration or not, each provided with an eccentric 11 which whether from a central drive or not, provides for the vibrating movement. Specially adapted for performing the process as described hereinbefore are the vibratory conveyors with a perforated bottom as described in U.S. Pat. No. 3,173,768. In vibratory conveyors of this type, it is possible to treat materials with a large quantity of moisture, without any risk of crusting or obturation of perforated bottoms, through which steam, hot or cold, dry or wet, air can be passed at will.

It should be noted that due to the vibratory motion of the vibratory conveyors, a certain loosening effect is produced which is enhanced by the gas (steam or air), supplied through the bottom of the vibratory conveyor.

What I claim is:

1. An installation for pre-treating oil-containing vegetable raw materials in order to allow the extraction of oil from the vegetable raw materials comprising:

(a) a first vibratory gutter having a perforated bottom and provided with means for subjecting the gutter to vibratory movement having a vertical component, said first gutter having a steam supply-opening connected to a source of steam pressure below said first gutter in order to subject the oil-containing vegetable raw material to a pre-treatment, said gutter having an overflow outlet;

(b) a second vibratory gutter having a perforated bottom and provided with means for subjecting the second gutter to vibratory movement having a vertical component, said second gutter having an inlet positioned below the outlet of the first gutter for receiving the material treated in the first gutter, means connected to a source of heated fluid for introducing a heated fluid below the perforated bottom of said second gutter in order to maintain the finely divided vegetable raw material at a temperature from 95° to 115° C. in said second gutter to inactivate enzymes having a detrimental action on the oil, said second gutter having an overflow outlet; and (c) a third gutter having a perforated bottom and provided with means for subjecting the third gutter to vibratory movement having a vertical component, said third gutter having an inlet positioned below the outlet of the second gutter for receiving the treated material from the second gutter, means connected to a source of drying gaseous fluid for supplying a drying gaseous fluid to the vegetable raw materials in said third gutter from below the perforated bottom of the third gutter to reduce the moisture content and the temperature of the raw vegetable materials to values required for extraction or crushing, said third gutter having an overflow outlet.

2. An installation as claimed in claim 1 wherein the gaseous fluid supplied to the third gutter is conditioned air.

3. An installation as claimed in claim 1 wherein the means for subjecting the first, second and third gutters to vibratory movement comprises a common unit for subjecting the three said gutters to vibratory movement.

* * * * *